US005407240A

United States Patent [19]

Andre et al.

[11] Patent Number: 5,407,240

[45] Date of Patent: Apr. 18, 1995

[54] LOCK FOR A SLIDING DOOR

[76] Inventors: Thomas J. Andre, 43081 W. Kirkwood Dr., Clinton Township, Macomb County, Mich. 48038; Donald L. Kerr, 2339 Cedar Key, Lake Orion, Mich. 48360

[21] Appl. No.: 144,393

[22] Filed: Nov. 2, 1993

[51] Int. Cl.[6] ..... E05C 5/00

[52] U.S. Cl. ..... 292/67; 292/189; 292/DIG. 46

[58] Field of Search ..... 292/67, 145, 147, 189, 292/183, 230, DIG. 9, DIG. 46, DIG. 47, 207

[56] References Cited

U.S. PATENT DOCUMENTS

| | | | |
|---|---|---|---|
| 333,240 | 12/1885 | Longbottom | 292/DIG. 9 X |
| 635,352 | 10/1899 | Sawtelle | 292/147 |
| 814,995 | 3/1906 | Trofford | 292/67 X |
| 946,141 | 1/1910 | Krier | 292/DIG. 9 X |
| 1,315,568 | 9/1919 | Neidhammer | 292/283 |
| 1,329,719 | 2/1920 | May | 292/67 |
| 1,346,065 | 7/1920 | Spivak | 292/67 |
| 1,589,149 | 6/1926 | Hanle | 292/DIG. 9 X |
| 1,769,470 | 7/1930 | Shankland | 292/DIG. 9 X |
| 3,213,652 | 10/1965 | Tucker | 70/97 |
| 3,405,961 | 10/1968 | Sanders | 292/207 |
| 3,471,189 | 10/1969 | Ness | 292/266 |
| 3,490,802 | 1/1970 | Zeit | 292/145 |
| 3,499,675 | 3/1970 | Isenberg | 292/263 |
| 3,768,847 | 10/1973 | Buck, Jr. et al. | 292/179 |
| 3,837,693 | 9/1974 | Adickes | 292/DIG. 9 X |
| 3,938,838 | 2/1976 | Brakensiek | 292/210 |
| 4,073,517 | 2/1978 | Bills | 292/60 |
| 4,480,862 | 11/1984 | Fleming | 292/162 |
| 4,486,057 | 12/1984 | Siwy | 292/281 X |
| 4,754,624 | 7/1988 | Fleming et al. | 70/95 |
| 4,824,153 | 4/1989 | Dugan | 292/262 |
| 4,974,887 | 12/1990 | Pucci | 292/228 |
| 4,989,908 | 2/1991 | Futch et al. | 292/341.15 |

*Primary Examiner*—Rodney M. Lindsey
*Attorney, Agent, or Firm*—Gifford, Groh, Sprinkle, Patmore & Anderson

[57] ABSTRACT

A door locking mechanism for locking a first slidable door to a second door. A base member is mounted to a side of the second door and is positioned parallel the first door. A hinge member is mounted to the base member so as to pivot about a vertical axis. A receiving member is mounted to a face of the first door so as to be engageable by the hinge member. The hinge member includes a slidable tab portion with a downwardly extending tab. The hinge member is rotated away from the base member and the tab portion is slid downward to engage the locking mechanism within the receiving member.

4 Claims, 1 Drawing Sheet

LOCK FOR A SLIDING DOOR

BACKGROUND OF THE INVENTION

1. Field of the Invention

The present invention relates to door locking mechanisms and, more particularly, to a lock for lockingly engaging one door slidable relative to another door.

2. Description of the Prior Art

Conventional door locking mechanisms for securely locking slidable doors are known in the art. Such mechanisms normally secure a sliding door relative to a door frame.

U.S. Pat. No. 3,499,675, issued to Isenberg, teaches a sliding door lock with a base arm and a second arm pivotally connected to the base arm. The arms extend from a folded to an unfolded position within a channel of the door frame to secure a slidable door against the door frame.

U.S. Pat. No. 3,938,838, issued to Brakensiek, teaches a sliding door lock with a base member attached to an upper edge of a door frame and a leaf member pivotally connected to the base member. The leaf member pivots about a horizontal axis relative to the base member to create an abutting stop and prevents a slidable door from opening.

A shortcoming of the prior art is the relative complexity of standard door locking mechanisms and their attendant cost of construction.

SUMMARY OF THE PRESENT INVENTION

The present invention is a lock for securing a first slidable door directly to a second door in a conventional doorwall assembly having first and second doors. The lock has a base member mounted to a vertical side of one of the doors perpendicular to the other of the doors. A hinge member is pivotally connected to the base member by a pin about a vertical axis. The hinge member includes a tab portion which is slidably attached to the hinge member along a vertically extending channel formed in the tab portion. An engaging tab extends downwardly from the tab portion. The hinge member is rotatable approximately ninety degrees from a first position where it is substantially parallel to the base member to a second position where it is substantially perpendicular to the base member and lies flat against the other door. A receiving member is mounted to the other door and has an opening for receiving the engaging tab. The tab portion is movable from a first upward position to a second downward position along the channel so that the engaging tab may be received within the opening of the receiving member.

BRIEF DESCRIPTION OF THE DRAWING

Reference will be made to the attached drawing, wherein like reference numbers refer to like parts throughout the several views and in which.

DESCRIPTION OF THE PREFERRED EMBODIMENT

Figure 1:
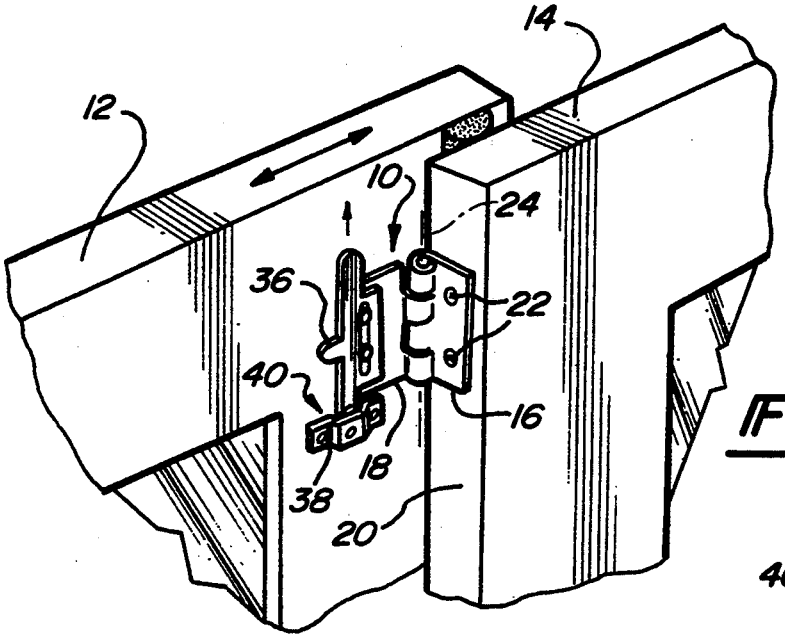
FIG. 1 is an elevational view in perspective of the door locking mechanism of the present invention for locking first and second slidable doors.
Figure 2:
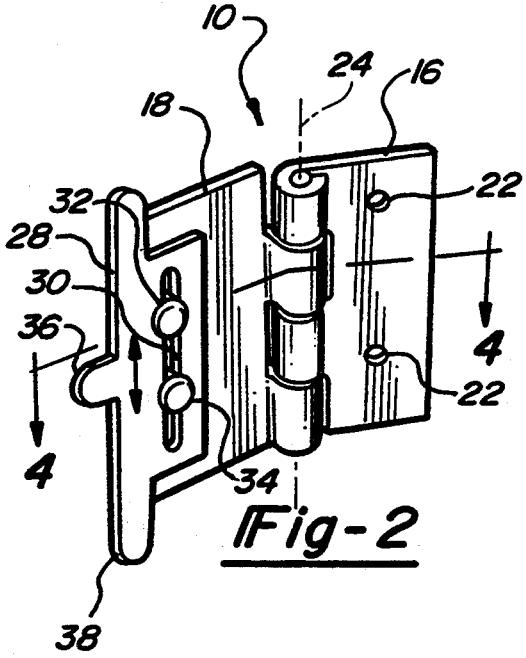
FIG. 2 is a view similar to that shown in FIG. 1 and showing the door lock with the tab portion vertically slidable relative to the hinge member.
Figure 5:
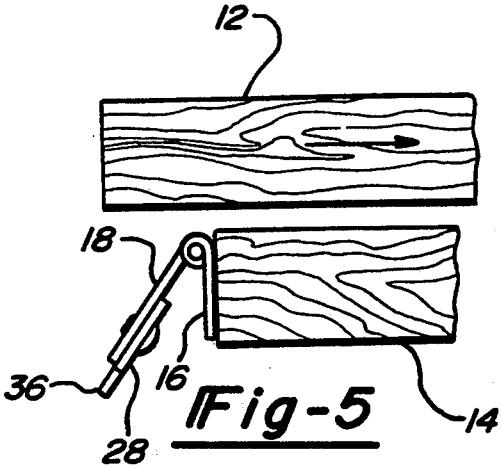
FIG. 5 is a top view of the door locking mechanism and shows the pivotal nature of the hinged member relative to the base member.
Figure 4:
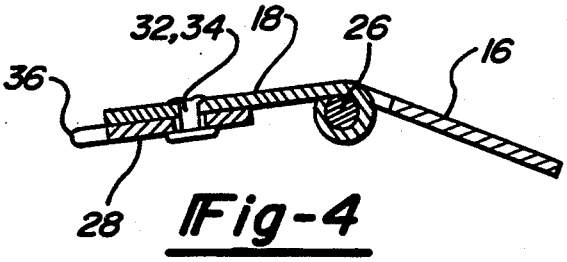
FIG. 4 is a view taken along lines 4—4 of FIG. 2 and shows the hinged connection between the base member and the hinge member.

Referring to FIG. 1, a sliding door lock 10 is shown for lockingly engaging a door 12 to a door 14. The door lock may be constructed of any durable material, and preferably is a strong and lightweight aluminum or similar metal. The door lock 10 is made up of a base member 16 and a hinge member 18. The base member is secured to a side 20 of the door 14 by fastening screws 22 or the like so as to be positioned at a ninety degree angle with respect to the door 12. The hinge member 18 is hingedly connected to the base member 16 at 24 and is held in place by a pin 26 (see FIG. 4). Referring further to FIG. 2, the hinged connection 24 between the base member 16 and the hinge member 18 enables the hinge member 18 to pivot about a vertical axis with respect to the base member 16. The hinge member 18 may be pivoted from a first position where it is substantially parallel to or only at a slight angle with respect to the base member 18 (see FIG. 5) to a second position when it lies against the fall of door 12 (FIG. 1).

Referring again to FIG. 2, a tab portion 28 is slidably mounted to the hinge portion 18. A vertically extending channel 30 is formed through the tab portion 28 and extends substantially the vertical distance of the tab portion 28. An upper button head pin 32 and a lower button head pin 34 project from the hinge portion 18 and secure the tab portion 28 along the channel 30. The vertical displacement of the tab portion 28 along the channel 30 is limited by contact of the ends of the channel 30 with either the upper or lower pins 32 and 34. The tab portion 28 further has a gripping portion 36 and a lower engaging tab 38 extending therefrom.

Figure 3:
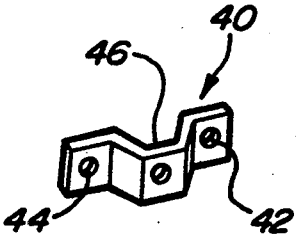
FIG. 3 is a view of a portion of the door locking mechanism shown in FIG. 1 and shows the receiving member to be mounted to one of the doors for receiving the tab portion of the hinge member.

Referring again to FIG. 1 and to FIG. 3, a receiving member 40 is provided and is mounted by conventional fasteners (not shown) through holes 42 and 44 to the door 12. The receiving member 40 is positioned on the door 12 so that it is in communication with the tab 38 extending downwardly from the tab portion 28 of the hinge member 18. The receiving member 40 has an outwardly contoured central portion which defines an opening or slot 46 for receiving the engaging tab 38 to lockingly engage the door 12 to the door 14.

In operation, the door 12 is slidable in a plane parallel to the door 14. The base member 16 of the door locking mechanism is mounted to the side 20 of the door 14 and the hinge member 18 is pivoted relative to the base member 16 so as to be out of the way of the sliding door 12 in an unlocked position. In order to engage the locking mechanism, the door 12 is first slid to a fully closed position. The hinge member is then grasped at the gripping portion 36 extending from the tab portion 28 and is rotated from a first position where the hinge member is parallel or at a slight angle relative to the base member to a second position where the hinge member is against the face of the door 12 and is approximately at a ninety degree angle with respect to the base member. While rotating the hinge member, the tab portion is at its maximum upward position with the bottom of the channel 30 engaging the button head pin 34. Once in position over the receiving member 40, the gripping member 36 is released and the tab portion slides downwardly to engage the tab 38 within the opening 46 of the receiving member.

The doors 12 and 14 are then locked into position relative to each other and cannot be slidably disengaged until the tab is lifted out of the receiving member and the hinge rotated away from the door 14.

In further embodiments, both of the doors 12 and 14 may be slidable relative to each other rather than only the door 12. Additional door locking mechanisms may be provided and can be spaced at predetermined points along the side 20 of door 14 to multiply the locking effect of the locks.

Having described my invention, additional embodiments will become apparent to those skilled in the art to which the invention pertains.

We claim:

1. A mechanism for locking in position a first slidable door with respect to a second door, comprising:

a base member mounted to a side of the second door;

a hinge member mounted to said base member so as to pivot about a vertical axis with respect to said base member;

a receiving member mounted to a face of the first door;

means for engaging said hinge member within said receiving member to lock the first door in position with respect to the second door when said hinge member is pivoted from a first position parallel to and adjacent said base member to a second position parallel and adjacent to said face of the first door; and.

a tab portion slidably connected to said hinge member;

an engaging tab extending downwardly from said tab portion, and wherein said tab portion is vertically slidable from an upward position to a downward position to engage said tab within said receiving member.

2. The invention as described in claim 1, said receiving member having an outwardly contoured central portion which creates an opening for receiving said engaging tab of said slidable tab portion.

3. The invention as described in claim 1, said tab portion further comprising:

a vertical channel formed through said tab portion;

a first and a second button head pin extending from said hinge member through said vertical channel to connect said tab portion to said hinge member; and a gripping portion for sliding said tab portion between said upward and downward position, said gripping portion further enabling said hinge member to be pivoted relative said base member.

4. The invention as described in claim 1, further comprising a pin for hingedly mounting said hinge member to said base member.

* * * * *

UNITED STATES PATENT AND TRADEMARK OFFICE

CERTIFICATE OF CORRECTION

PATENT NO. : 5,407,240

DATED : April 18, 1995

INVENTOR(S) : Thomas J. Andre et al.

It is certified that error appears in the above-indentified patent and that said Letters Patent is hereby corrected as shown below:

Column 2, line 28, "fall" should be --face--.

Signed and Sealed this

Twenty-seventh Day of February, 1996

*Attest:*

BRUCE LEHMAN

*Attesting Officer*

*Commissioner of Patents and Trademarks*